US012352286B1

(12) United States Patent
Greulich et al.

(10) Patent No.: US 12,352,286 B1
(45) **Date of Patent: *Jul. 8, 2025**

(54) TRUCK COOLER FAN

(71) Applicant: Patterson Fan Company, Blythewood, SC (US)

(72) Inventors: Douglas R. Greulich, Columbia, SC (US); Warren R. Garrison, Columbia, SC (US); Eric A. Trofatter, Columbia, SC (US)

(73) Assignee: Patterson Fan Company, Blythewood, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/616,722

(22) Filed: Mar. 26, 2024

Related U.S. Application Data

(63) Continuation of application No. 18/127,987, filed on Mar. 29, 2023, now Pat. No. 11,965,523.

(Continued)

(51) Int. Cl.

| | |
|---|---|
| ***F04D 29/42*** | (2006.01) |
| ***F04D 17/16*** | (2006.01) |
| ***F04D 29/44*** | (2006.01) |

(52) U.S. Cl.

CPC ..... *F04D 29/4206* (2013.01); *F04D 17/16* (2013.01); *F04D 29/4226* (2013.01); *F04D 29/441* (2013.01)

(58) Field of Classification Search

CPC .... F04D 29/441; F04D 29/444; F04D 29/281; F04D 29/282; F04D 29/283; F04D 17/16

See application file for complete search history.

(56) References Cited

U.S. PATENT DOCUMENTS

| | | | | |
|---|---|---|---|---|
| D152,778 S | | 2/1949 | Fox | |
| 3,469,772 A | * | 9/1969 | McDonald | F04D 29/668 417/350 |

(Continued)

FOREIGN PATENT DOCUMENTS

| | | | | |
|---|---|---|---|---|
| CN | 301576199 S | | 6/2011 | |
| CN | 302384712 S | | 4/2013 | |
| DE | 102009018117 A1 | * | 11/2010 | F04D 25/068 |

OTHER PUBLICATIONS

Design U.S. Appl. No. 29/833,032 entitled "Fan", filed Mar. 31, 2022. Specification, drawings and filing receipt enclosed.

(Continued)

*Primary Examiner* — Justin D Seabe

(74) *Attorney, Agent, or Firm* — Nelson Mullins Riley & Scarborough LLP

(57) ABSTRACT

A fan apparatus has a housing with an enlarged portion defining at least one air intake and an outlet portion defining an outlet port. The outlet port has a greater width and a lesser height. A blower wheel having a plurality of fan blades is supported in the enlarged portion of the housing for rotation about an axis. A driver is connected to the blower wheel to cause rotation of the blower wheel. A flow straightener assembly is located in the outlet portion of the housing. The flow straightener assembly has first and second fins spaced apart from one another and oriented substantially orthogonal to the axis of the blower wheel. Third and fourth fins are located outside of a respective one of the first and second fins, the third and fourth fins being oriented substantially parallel to the axis of the blower wheel.

16 Claims, 11 Drawing Sheets

Related U.S. Application Data

(60) Provisional application No. 63/326,026, filed on Mar. 31, 2022.

(56) References Cited

U.S. PATENT DOCUMENTS

| | | | | |
|---|---|---|---|---|
| 4,651,966 | A | 3/1987 | Suzuki | |
| 4,973,016 | A | 11/1990 | Hertenstein | |
| 5,399,068 | A * | 3/1995 | Park | F04D 29/4226 415/206 |
| D361,414 | S | 8/1995 | Trautloff et al. | |
| 5,601,400 | A | 2/1997 | Kondo et al. | |
| 6,821,095 | B2 | 11/2004 | Dooley et al. | |
| D517,677 | S | 3/2006 | Bartholmey | |
| D530,002 | S | 10/2006 | Ching | |
| D625,799 | S | 10/2010 | Salisbury et al. | |
| 8,353,665 | B1 | 1/2013 | Stockstill et al. | |
| D705,408 | S | 5/2014 | Patterson et al. | |
| D753,806 | S | 4/2016 | Patterson et al. | |
| D771,229 | S | 11/2016 | Stalgren et al. | |
| D835,254 | S | 12/2018 | Sanders et al. | |
| D837,964 | S | 1/2019 | Cui | |
| D849,924 | S | 5/2019 | Sanders et al. | |
| 10,323,853 | B2 * | 6/2019 | Zakula | F04D 29/441 |
| D869,631 | S | 12/2019 | Tschopp | |
| D869,632 | S | 12/2019 | He et al. | |
| D869,633 | S | 12/2019 | He et al. | |
| 10,570,928 | B2 | 2/2020 | Cocks | |
| D927,680 | S | 8/2021 | Schmidt | |
| D934,404 | S | 10/2021 | Seckinger, Sr. et al. | |
| D936,203 | S | 11/2021 | He et al. | |
| 11,215,346 | B2 * | 1/2022 | Wiegel | F21V 21/34 |
| 11,378,284 | B2 * | 7/2022 | Lockwood | F24F 1/0029 |
| 11,480,186 | B2 | 10/2022 | Johnson et al. | |
| D1,015,523 | S | 2/2024 | Liu | |
| 11,965,523 | B1 | 4/2024 | Greulich et al. | |
| 2004/0022627 | A1 | 2/2004 | Hanchett | |
| 2005/0169782 | A1 | 8/2005 | Nishikawa et al. | |
| 2016/0290358 | A1 | 10/2016 | Hayamitsu et al. | |
| 2019/0128281 | A1 | 5/2019 | He et al. | |
| 2019/0230814 | A1 * | 7/2019 | Hatanaka | F04D 29/4226 |
| 2021/0222695 | A1 | 7/2021 | Demirdjian | |

OTHER PUBLICATIONS

YouTube Video by Patterson Fan Co. entitled "HVTC: The Ultimate Loading Dock Fan/Truck Trailer Air Movement", dated Feb. 10, 2022, youtube.com/watch?v=g8ADCtuof6M.

NPL.AmazonTinEye Oct. 9, 2020, Amazon.com via TinEye, sites visited Oct. 9, 2024: https://tineye.com/search/293391e6710a961a96c6ba32e9d03c818293ad87?sort=crawl_date&order=asc&page=1 ( 2020).

NPL. TinEye Jun. 17, 2017, TinEye.com, site visited Oct. 9, 2024: https://tineye.com/search/b0009358b5eb5af02a528a5503cd259f05d5668b?sort=crawl_date&order=asc&page=1 (2017).

NPL.X Mar. 29, 2022, X.com, site visited Oct. 9, 2024: https://x.com/PattersonFanCo/status/1508866785541607427 (2022).

NPL.YouTube Feb. 10, 2022, YouTube.com, site visited Oct. 9, 2024: https://www.youtube.com/watch?v=g8ADCtuof6M&t=3s (2022).

Office Action, U.S. Appl. No. 29/833,032 dated Nov. 15, 2024, 11 pages.

* cited by examiner

TRUCK COOLER FAN

CROSS-REFERENCE TO RELATED APPLICATIONS

This application is a continuation of co-pending application Ser. No. 18/127,987, filed Mar. 29, 2023, which is based upon and claims the benefit of provisional application Ser. No. 63/326,026, filed Mar. 31, 2022. Each of the aforementioned applications is incorporated fully herein by reference for all purposes.

FIELD OF THE INVENTION

Embodiments of the present invention relate generally to an improved cooler fan for moving hot air out of a trailer of a semi-trailer truck prior to loading or unloading.

BACKGROUND OF THE INVENTION

Semi-trailer trucks and other shipping containers often lack ventilation systems to effectively control the temperature within a trailer. As a result, the temperatures within the trailer may become very high over time, such has when the trailer is being transported. In some cases, the temperature within the trailer may exceed 145 degrees Fahrenheit. It is inappropriate for workers to load and unload the trailer in such temperatures.

Cooler fans are often installed at a loading dock and configured to blow air into the open end of a trailer. The goal of such fans is to replace the air inside the trailer with outside air. These fans, however, often generate outlet air of insufficient velocity to exchange completely the air inside the trailer. These fans may also generate outlet air that spreads quickly, thus failing to reach the back of the trailer with sufficient velocity. As a result, the generated outlet air will only travel partially into the trailer before the airflow becomes highly turbulent, so the outlet air may fail to reach the rear portions of the trailer. Consequently, previous fans have been limited in their ability to cool the rear portions of a trailer.

The present invention recognizes the foregoing considerations, and others, of the prior art.

SUMMARY OF THE INVENTION

In accordance with one aspect, the present invention provides a fan apparatus comprising a housing having an enlarged portion defining at least one air intake and an outlet portion defining an outlet port. The outlet port has a width and a height, with the width being greater than the height. A blower wheel having a plurality of fan blades is supported in the enlarged portion of the housing for rotation about an axis. For example, the blower wheel may have a generally cylindrical configuration with the fan blades being spaced apart around a periphery thereof in parallel with the axis. A driver (e.g., an electric motor) is connected to the blower wheel to cause rotation of the blower wheel.

The fan apparatus according to this aspect further includes a flow straightener assembly in the outlet portion of the housing. The flow straightener assembly has first and second fins spaced apart from one another and oriented substantially orthogonal to the axis of the blower wheel. The flow straightener assembly further has third and fourth fins outside of a respective one of the first and second fins, the third and fourth fins being oriented substantially parallel to the axis of the blower wheel.

In some exemplary embodiments, the flow straightener assembly further comprises a fifth fin extending between the first and second fins, the fifth fin being oriented substantially parallel to the axis of the blower wheel. For example, the fifth fin may be substantially aligned with the third and fourth fins across the width of the outlet port. A plurality of hand guards may extend from and be orthogonal to the fifth fin. The fifth fin may have a rearward length less than 60% that of the third and fourth fins.

In some exemplary embodiments, the first and second fins may each have a rearward portion with a curved profile following an outer diameter of the blower wheel. The third and fourth fins in such embodiments may extend from the outlet port to the curved profile of the first and second fins, respectively. The first and second fins may preferably be located at less than 20 percent and greater than 80 percent of the width of the outlet port, respectively.

In some exemplary embodiments, upper left and upper right flow sections respectively formed by the first fin and the third fin, and the second fin and the forth fin, are blocked. Respective lights may be positioned at the upper left and upper right flow sections.

In some exemplary embodiments, the fan apparatus may further comprise a mounting bracket attached to the housing. A pivot arm having a proximal end for pivotal attachment to a fixed structure and a distal end for pivotal attachment to the mounting bracket is also provided.

Another aspect of the present invention provides a fan apparatus comprising a housing defining at least one air intake and an outlet portion defining an outlet port. The outlet port has a width and a height, with the width being greater than the height. A blower wheel is supported in the housing for rotation about an axis, the blower wheel having a generally cylindrical configuration with a plurality of fan blades spaced apart around a periphery thereof in parallel with the axis. A driver is connected to the blower wheel to cause rotation of the blower wheel.

The fan apparatus according to this aspect further comprises a flow straightener assembly in the outlet portion of the housing. The flow straightener assembly has first and second fins spaced apart from one another and oriented substantially orthogonal to the axis of the blower wheel. The first and second fins according to this aspect are located at less than 20 percent and greater than 80 percent of the width of the outlet port, respectively. In addition, the first and second fins may each have a rearward portion with a curved profile following an outer diameter of the blower wheel.

Other objects, features, and aspects of the present invention are provided by various combinations and subcombinations of the disclosed elements, as well as methods of practicing same, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
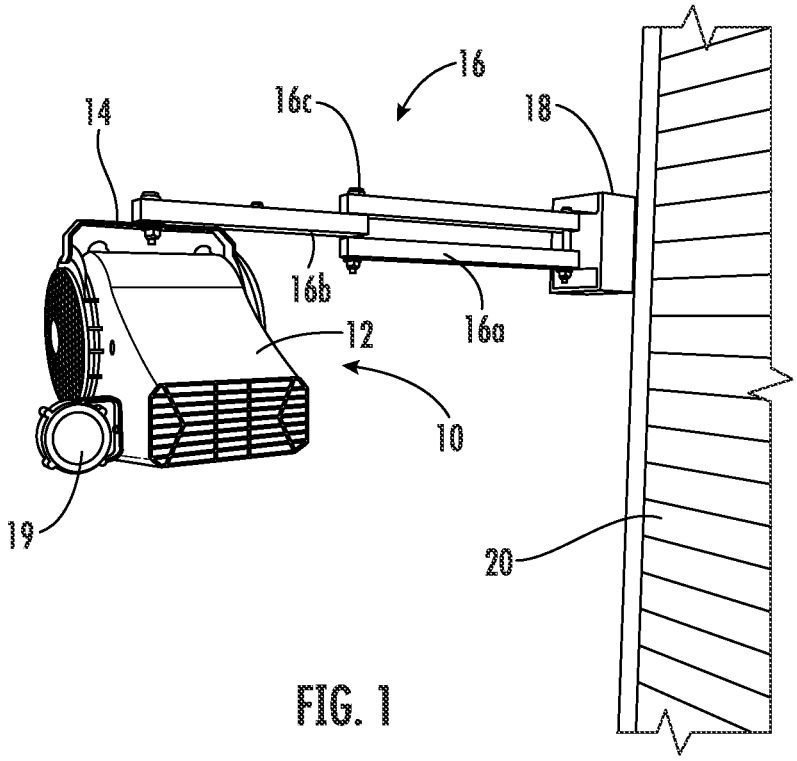
FIG. 1 is a perspective view of a truck cooler fan in accordance with an embodiment of the present invention installed for use at a loading dock.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only and is not intended as limiting the broader aspects of the present invention, which broader aspects are embodied in the exemplary constructions.

FIG. 1 illustrates an improved fan apparatus 10 in accordance with an embodiment of the present invention. In this case, fan apparatus 10 is utilized as a "truck cooler" to exchange the air in a semi-trailer, such as before loading. In this regard, fan apparatus 10 includes a housing 12 to which a mounting bracket 14 is attached. Via bracket 14, housing 12 is pivotally supported at the distal end of a swing arm 16. The proximal end of swing arm 16 is pivotally attached to a fixed mount 18 adjacent to a loading dock door 20. In this case, swing arm 16 is a freely movable articulating arm having first and second arm segments 16*a* and 16*b* pivotally connected to each other at pivot point 16*c*.

Housing 12 may be formed of any suitable material, such as molded plastic. For example, molded pieces forming different parts of the housing may be connected together, such as by screws, to complete the housing structure. In this embodiment, a spotlight 19 is mounted outboard of housing 12 to illuminate the area where the fan is aimed. Spotlight 19 will comprise a suitable illumination source, such as a cluster of visible light LEDs mounted adjacent to a reflective surface.

As one skilled in the art will appreciate, door 20 is raised when the back of the semi-trailer is positioned adjacent the loading dock for loading and unloading. If it is desired to exchange the air in the trailer (e.g., to lower the interior temperature), fan apparatus 10 is swung from a stored (out of the way) position to a position nearer the back of the trailer (so as to blow into the back of the trailer). Fan apparatus 10 is then energized for a sufficient time to suitably exchange air in the trailer before being moved back to the stored position.

Figure 2:
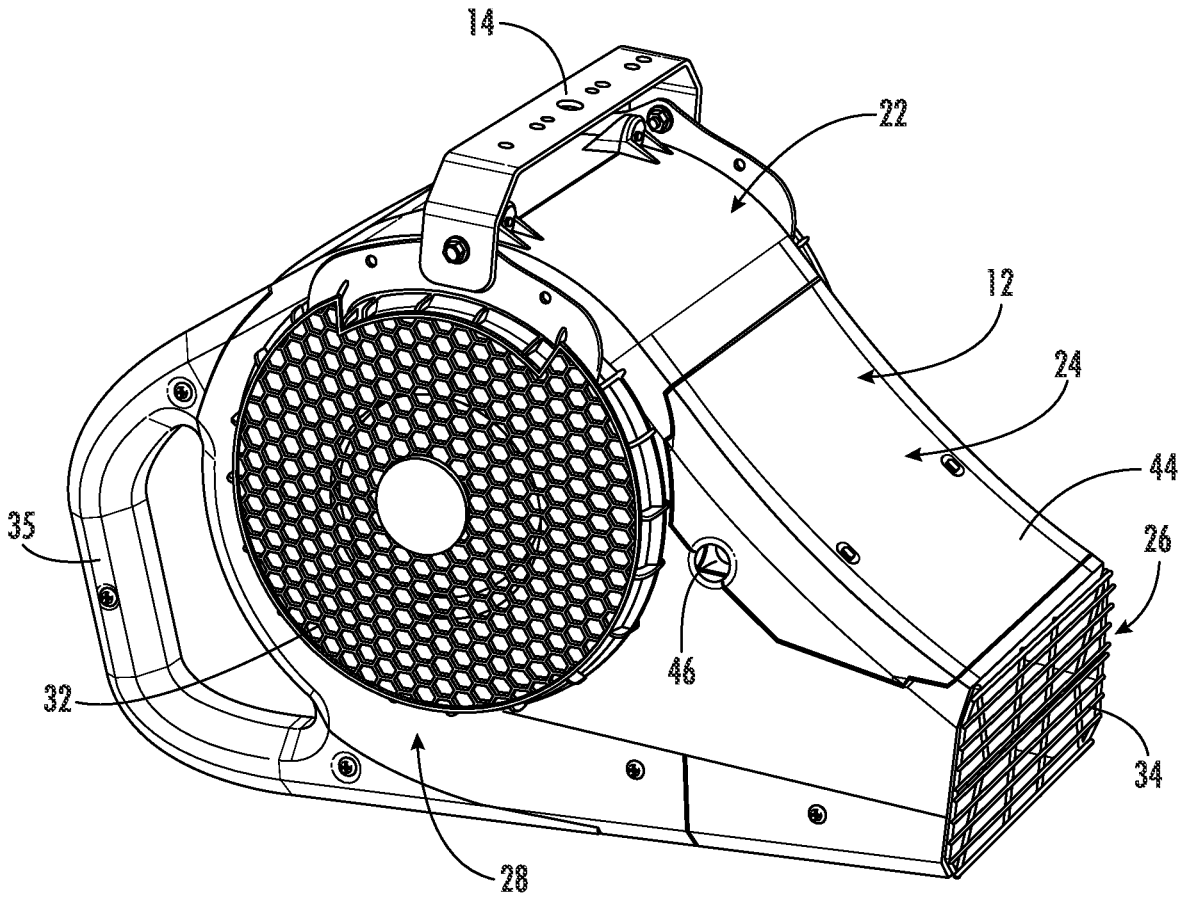
FIG. 2 is a perspective view of the truck cooler fan of FIG. 1.
Figure 3:
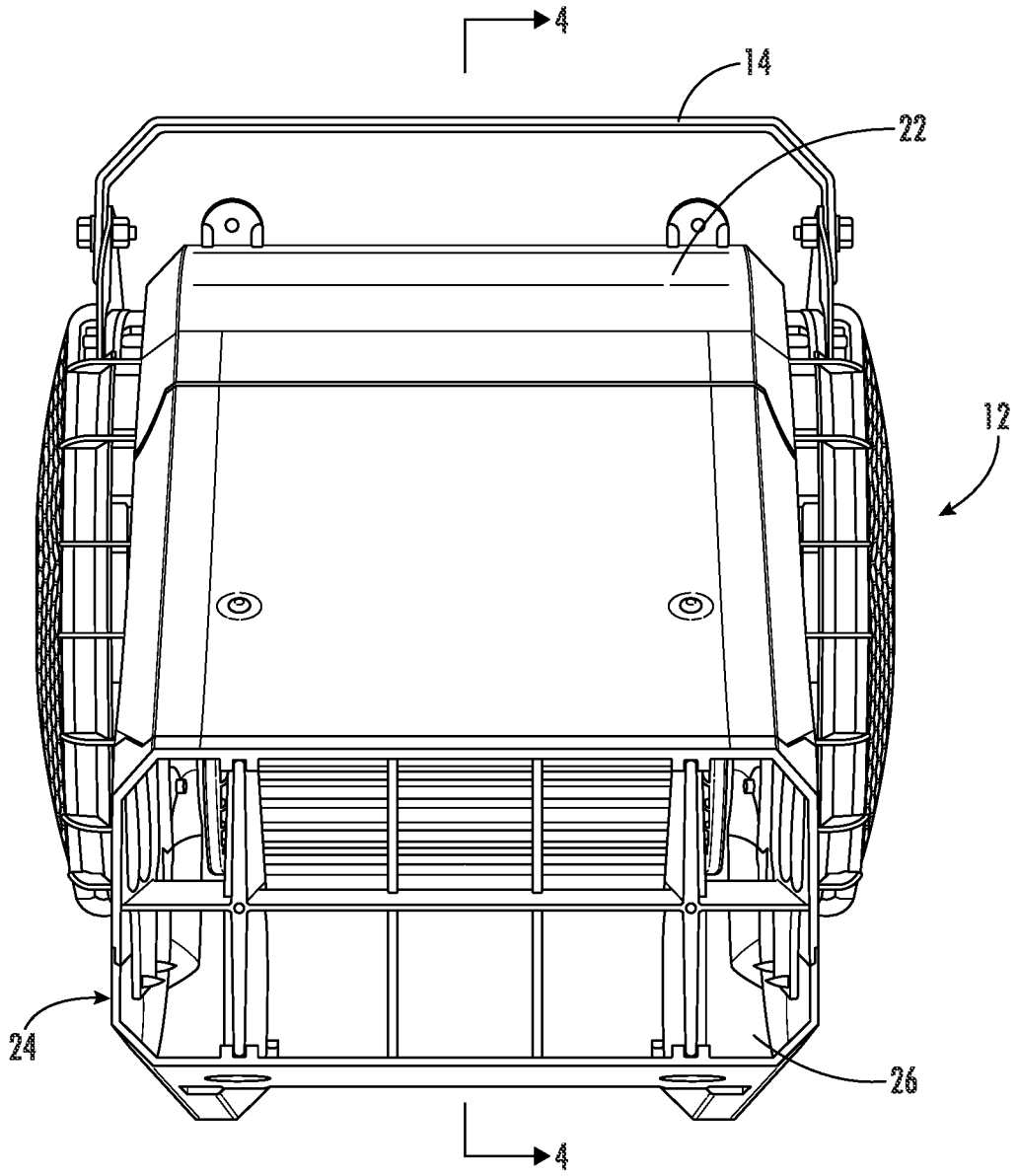
FIG. 3 is a front view of the truck cooler fan of FIG. 1.
Figure 4:
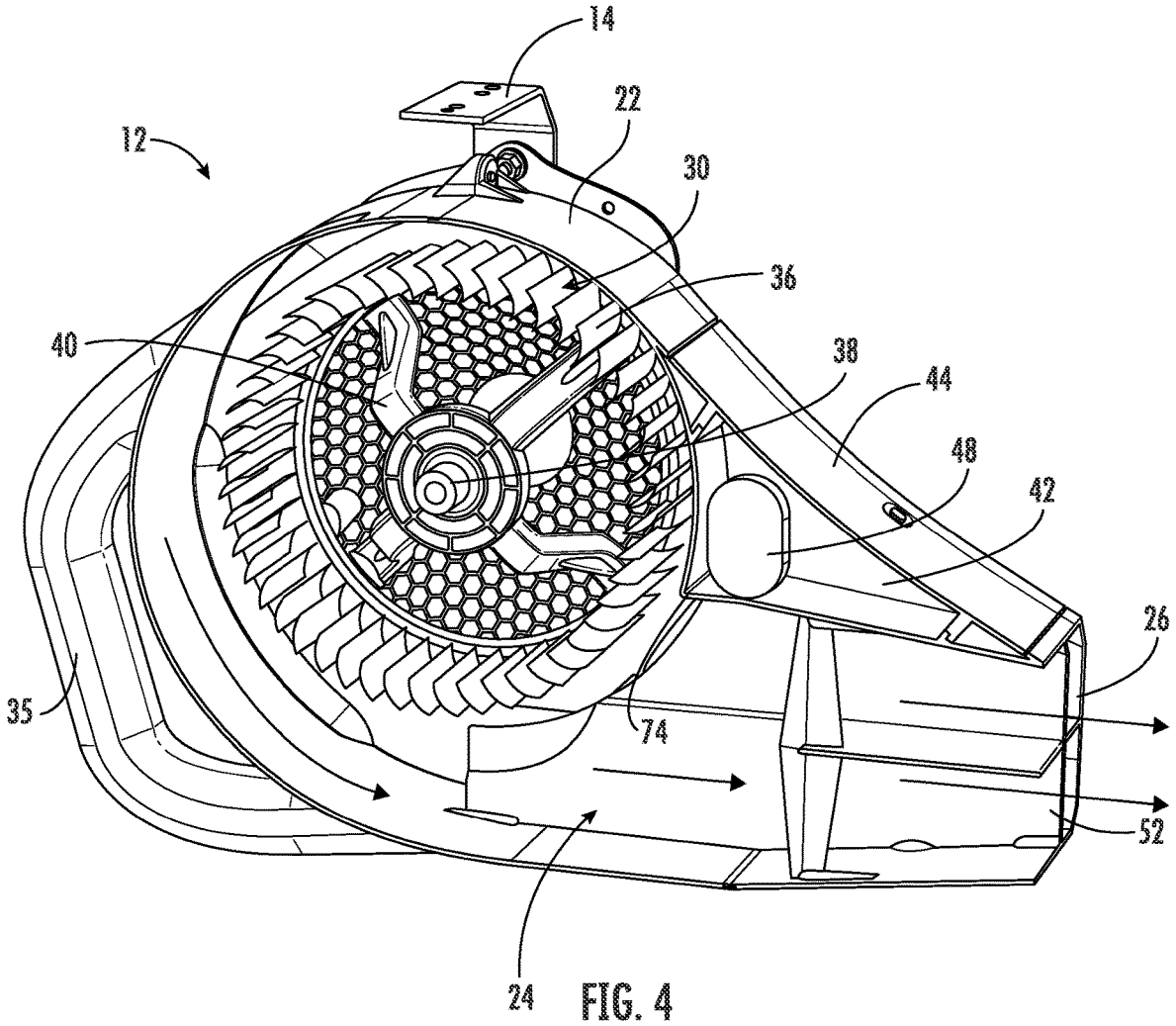
FIG. 4 is a cross-sectional view taken along line 4-4 of FIG. 3.

Referring now to FIGS. 2-4, certain additional details regarding fan apparatus 10 can be most easily explained. In this case, housing 12 defines an enlarged portion 22 integrally extending into an outlet portion 24 defining an outlet port 26. The enlarged portion 22 defines a pair of air intakes (e.g., air intake 28) on its respective sides. Air drawn into the sides by the blower wheel 30 (FIG. 4) is directed along the interior of enlarged portion 22 into outlet portion 24. The air then exits outlet port 26 under pressure. The air intakes and outlet port may each be covered by a suitable screen (e.g., screens 32 and 34) which limits access to the interior of housing 12 but does not substantially interfere with the flow of air. Housing 12 may include one of more handles 35 to facilitate movement of the fan apparatus 10 by an operator.

Referring now particularly to FIG. 4, blower wheel 30 in this embodiment has a generally cylindrical configuration with a plurality of fan blades (e.g., fan blade 36) spaced apart around the blower wheel's periphery in parallel with the rotational axis of the blower wheel. The rotational axis of the blower wheel is formed by a central axle 38 (shown in part in FIG. 4) that is supported for rotation in the housing 12, such as by the motor and a spider bracket 40. First and second axial sides of the blower wheel 30 may be separated by a central disc 42 (FIG. 12) to allow air to enter through the respective air intakes on the two sides.

Axle 38 is turned by a suitable driver, which thus causes rotation of blower wheel 30. In this embodiment, for example, blower wheel 30 is intended to rotate in a counterclockwise direction (as viewed in FIG. 4). For example, the driver may comprise a motor (e.g., a ¾ HP motor) mounted to the outer side of spider 40. In this case, the output shaft of the motor may be keyed directly to the axle 38 of the blower wheel 30. Wiring for the motor may be connected inside of an integral junction box 42 defined in the contour of housing 12. In this embodiment, a removable cover 44 provides access to the interior of junction box 42. Wiring for connection to a mains source exits the junction box 42 at through hole 46 (FIG. 2). As shown in FIG. 4, junction box 42 may contain a starting capacitor 48 to facilitate operation of fan apparatus 10.

Referring now to FIGS. 4-6 and 15, fan apparatus 10 includes a flow straightener assembly 50 in the outlet portion 24 of housing 12. In accordance with the present invention, it was realized that prior art fans using a similar blower wheel often experienced substantial turbulence at the outlet port. This turbulence causes the air to spread quickly after exiting the fan, thus failing to reach the back of the trailer with sufficient velocity. Assembly 50 directs the flow of air in a manner that substantially enhances the effectiveness of fan apparatus 10.

In the present embodiment, assembly 50 includes a plurality of fins that divide the air passing through outlet portion 24. Specifically, assembly 50 includes a pair of vertical fins 52 and 54 separated by a central horizontal fin 56. A pair of lateral horizontal fins 58 and 60 are located outboard of fins 52 and 54, respectively. As can be seen, fins 56, 58, and 60 are horizontally aligned in this case, although embodiments are contemplated in which these fins are not horizontally aligned. In this embodiment, a pair of vertical hand guards 62 and 64 are mounted to fin 56 in order to further limit access to the interior of fan apparatus 10. Additional features, such as those shown at 66 and 68, may be integrated with assembly 50 to facilitate mounting of assembly 50 within housing 12.

Figure 6:
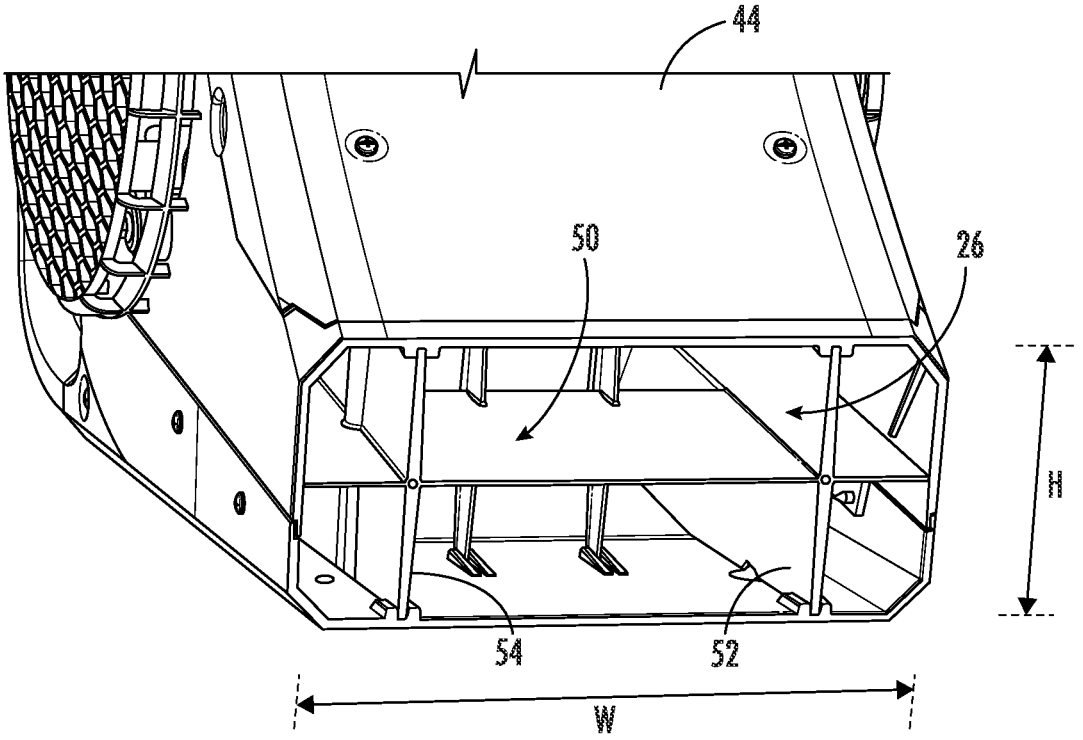
FIG. 6 is an enlarged fragmentary front perspective view of the outlet port of the truck cooler fan of FIG. 1 showing six flow sections created by the flow straightener assembly illustrated in FIG. 5.
Figure 15:
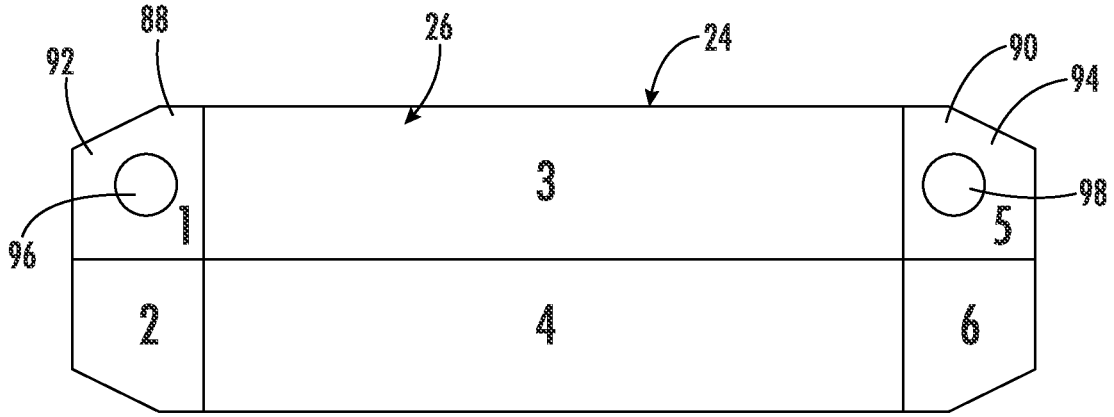
FIG. 15 shows an alternative embodiment in which at least one of sections 1 and/or 5 is blocked.

As can be seen in FIGS. 6 and 15, assembly 50 in this case divides the flow into six flow sections (zones), labeled "1" through "6" (see FIG. 15). As will be explained below, very little flow emerges from sections 1 and 5 in the embodiment of FIG. 6, therefore they may be closed without substantially affecting overall performance. (An embodiment with sections 1 and 5 closed is described below in reference to FIG.

15.) Flow from sections 2-4 and 6 will be very straight and uniform without substantial turbulence at outlet port 26.

Certain additional details of flow straightener assembly 50 will now be described. As can be seen in FIG. 6, outlet port 26 has a width W which is greater than its height H. Vertical fins 52 and 54 are positioned across the width such that sections 3 and 4 are substantially wider than sections 1, 2, 5, or 6. In fact, section 3 is up to approximately twice as wide as the width of section 1 and section 5 added together. Similarly, section 4 is up to approximately twice as wide as the width of section 2 and section 6 added together. This is accomplished by having fins 52 and 54 substantially closer to the sides of outlet port 26 than they are to each other. For example, fins 52 and 54 may be located at less than 20 percent and greater than 80 percent of the width of the outlet port, respectively (when viewed from right to left in FIG. 6).

Figure 5:
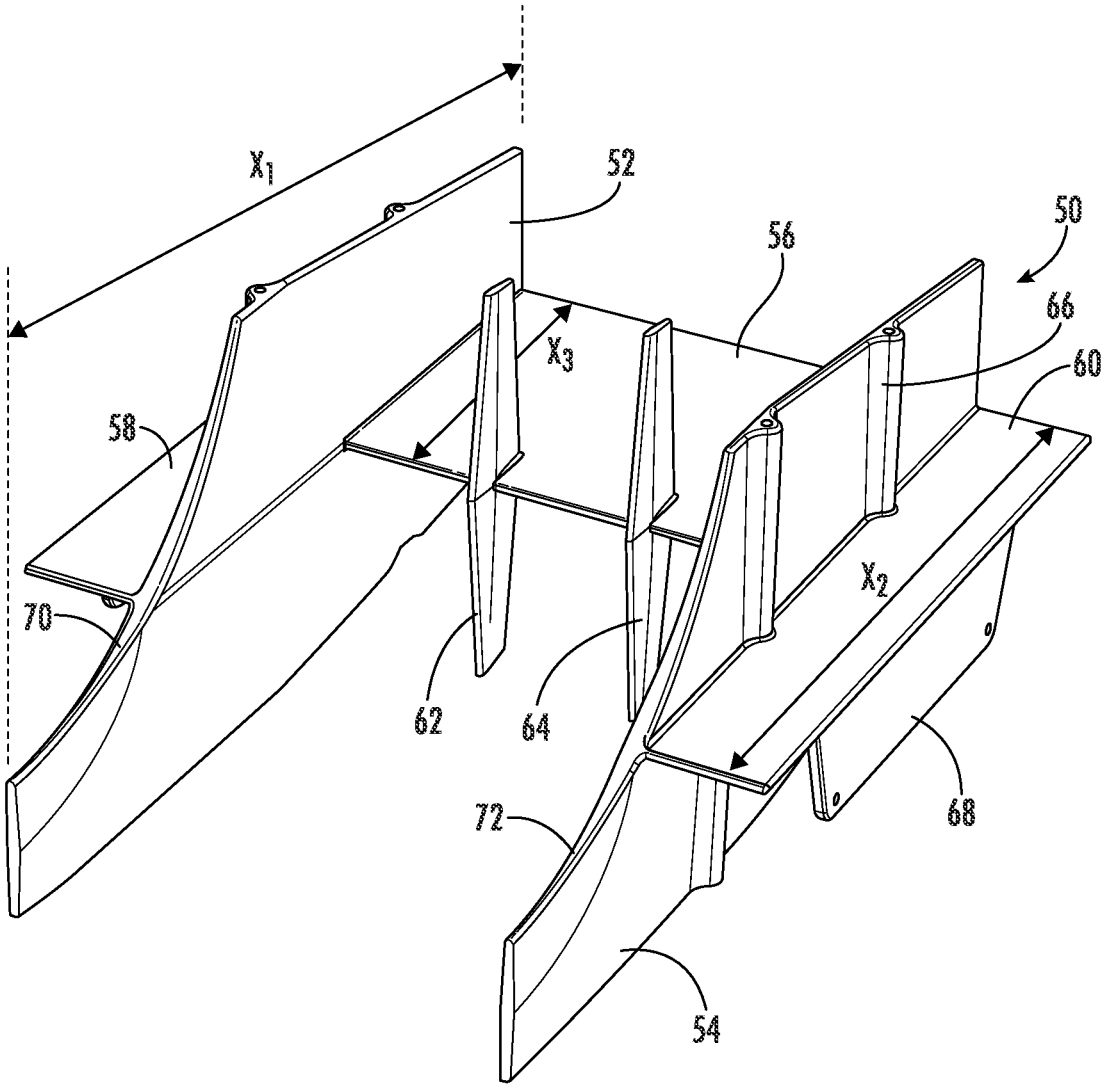
FIG. 5 is a perspective view of a preferred configuration of a flow straightener assembly for use with the truck cooler fan of FIG. 1.

As can be particularly seen in FIGS. 4 and 5, fins 52 and 54 have a longitudinal extent (length $X_1$) greater than fins 56, 58, and 60. In this regard, fins 52 and 54 extend from outlet port 26 back into the enlarged portion 22 of housing 12, to a location almost directly below axle 38. The rearward portions of fins 52 and 54 define a respective upper curved profile 70 and 72 that, as shown, follow the outer diameter of the blower wheel 30. Curved profiles 70 and 72 extend from the end of the respective fins 52 and 54 under the blower wheel 30 to the pressure brake 74 formed by the housing interior. Fins 58 and 60 have a length $X_2$ extending from outlet port 26 until they reach the respective curved profile 70 or 72. In this embodiment, fin 56 has a length that is substantially less than that of fins 58 and 60. For example, fin 56 may preferably have a length $X_3$ from outlet port 26 to its rear edge that is no more than about 60% of the length of fins 58 and 60.

In a particularly preferred embodiment, the various dimensions discussed above may be approximately as follows: H=5 inches (inner height); W=11.5 inches (inner width); $X_1$=14.4 inches; $X_2$=11 inches; $X_3$=5.6 inches. Of course, any suitable dimensions are contemplated within the scope of the present invention.

Figure 7:
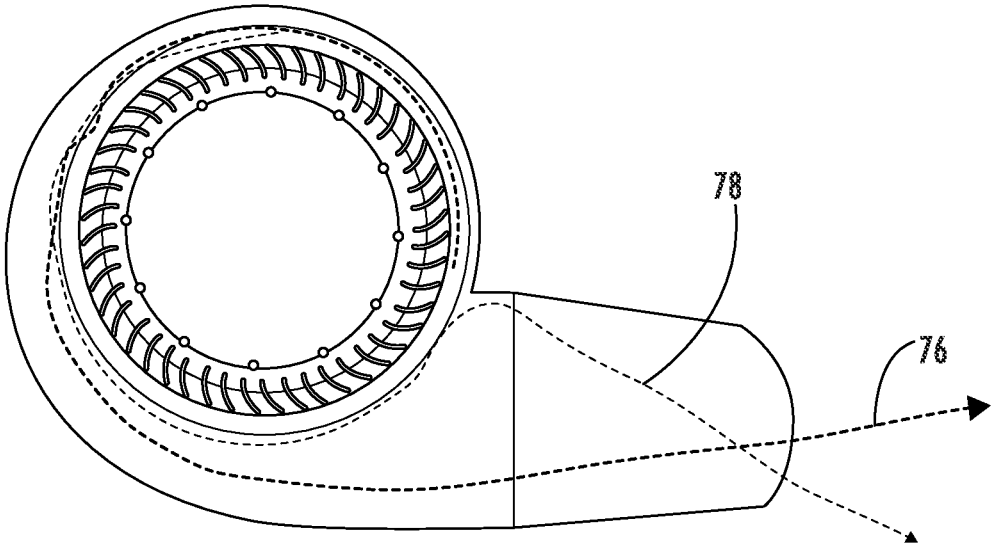
FIG. 7 PRIOR ART
FIGS. 7-9 are diagrammatic representations showing a flow pattern resulting from a prior art arrangement without a flow straightener.
Figure 8:
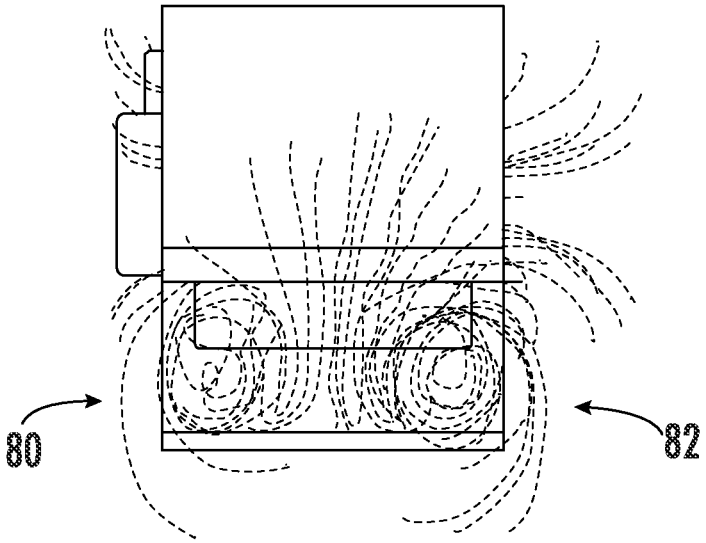
FIG. 8 PRIOR ART
Figure 9:
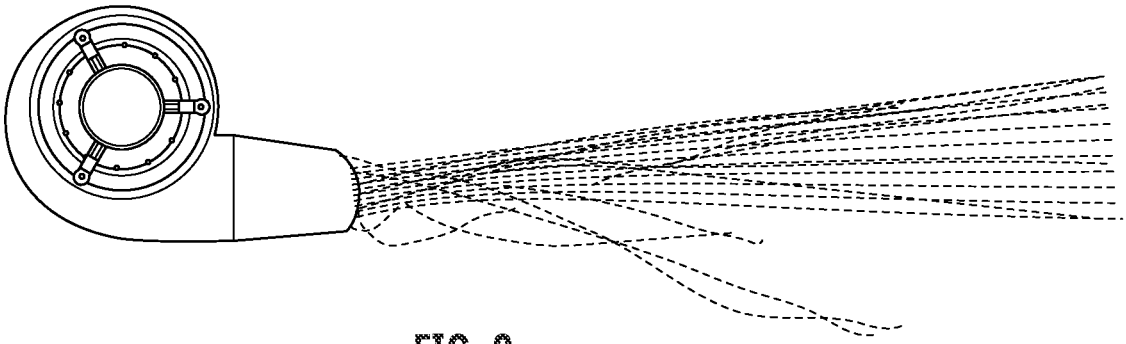
FIG. 9 PRIOR ART

In order to most easily explain certain aspects of the present invention, it is helpful to first review certain issues that were encountered in the prior art. In this regard, FIGS. 7-9 illustrate air flow patterns in a prior art fan having a blower wheel like blower wheel 30. The air coming off the blower wheel is most easily described in two ways: (1) higher energy air that leaves the wheel because it has gained enough rotational velocity to be flung off the wheel; and (2) lower energy air that leaves the wheel because it has been scraped off by the pressure brake. These are indicated at 76 and 78, respectively.

The higher energy air will continue on a path tangent to the wheel, which results in a mostly straight airflow in the center, slightly justified in the upward direction. As indicated at 80 and 82 (FIG. 8), the lower energy air develops a double spiral in the downward direction upon colliding with the higher energy air. This results in some scattering and overall loss of energy in the resulting air column 84 (FIG. 9).

Figure 10:
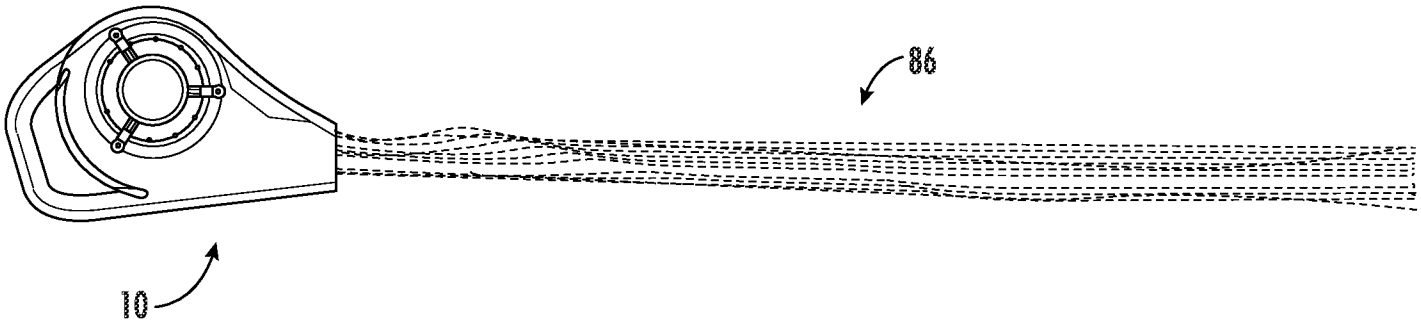
FIGS. 10-11 are diagrammatic representations showing a flow pattern utilizing a flow straightener according to the present invention.
Figure 11:
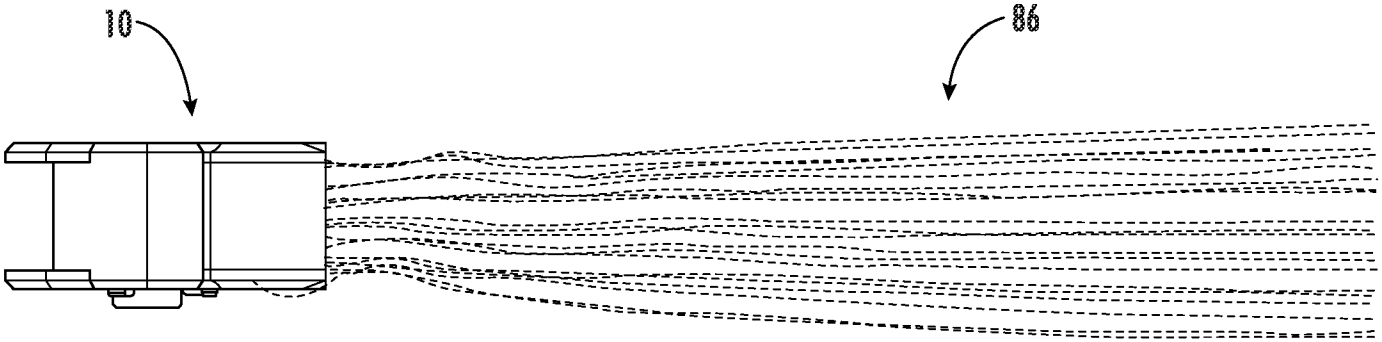

FIGS. 10 and 11 illustrate an air column 86 that may be produced by fan apparatus 10 utilizing a similar blower wheel and motor of the prior art fan shown in FIGS. 7-9. As can be seen, the air column is narrow, straight, and does not exhibit the turbulent spirals seen in the prior art. During empirical testing, it was found that two people could stand six feet apart eighty feet down range and not feel any substantial air from the fan but with a strong air column passing between them. Such an air column easily reaches the back of a typical semi-trailer to exchange the air inside the trailer quickly.

Figure 12:
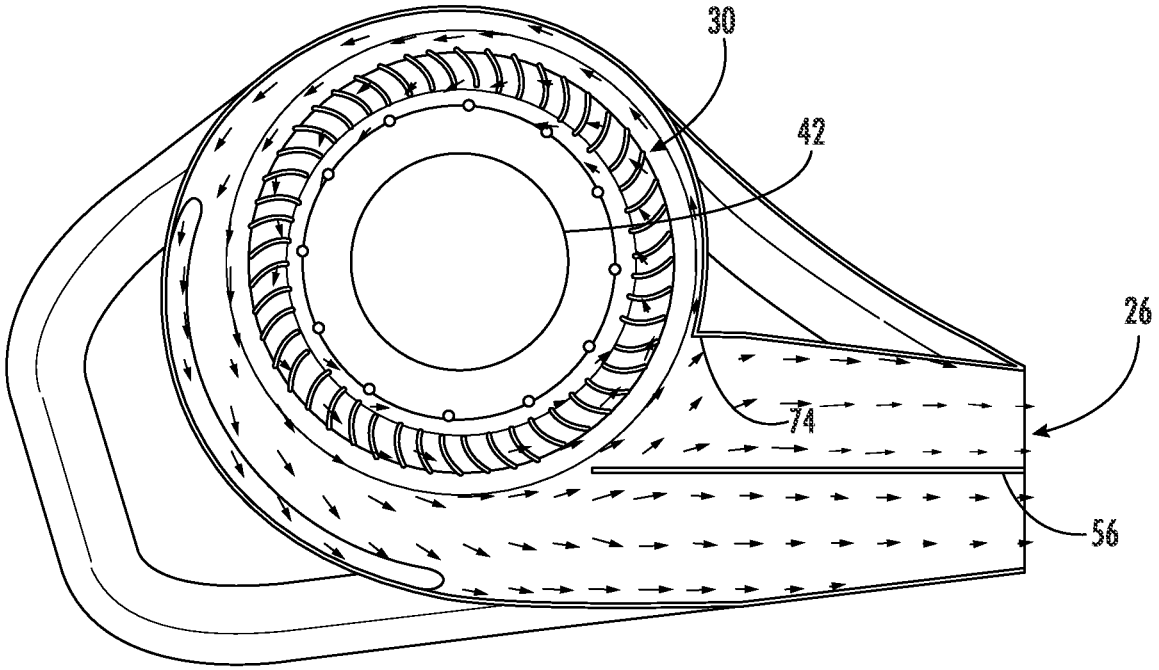
FIGS. 12-13 are diagrammatic representations showing flow in sections 3 and 4.
Figure 13:
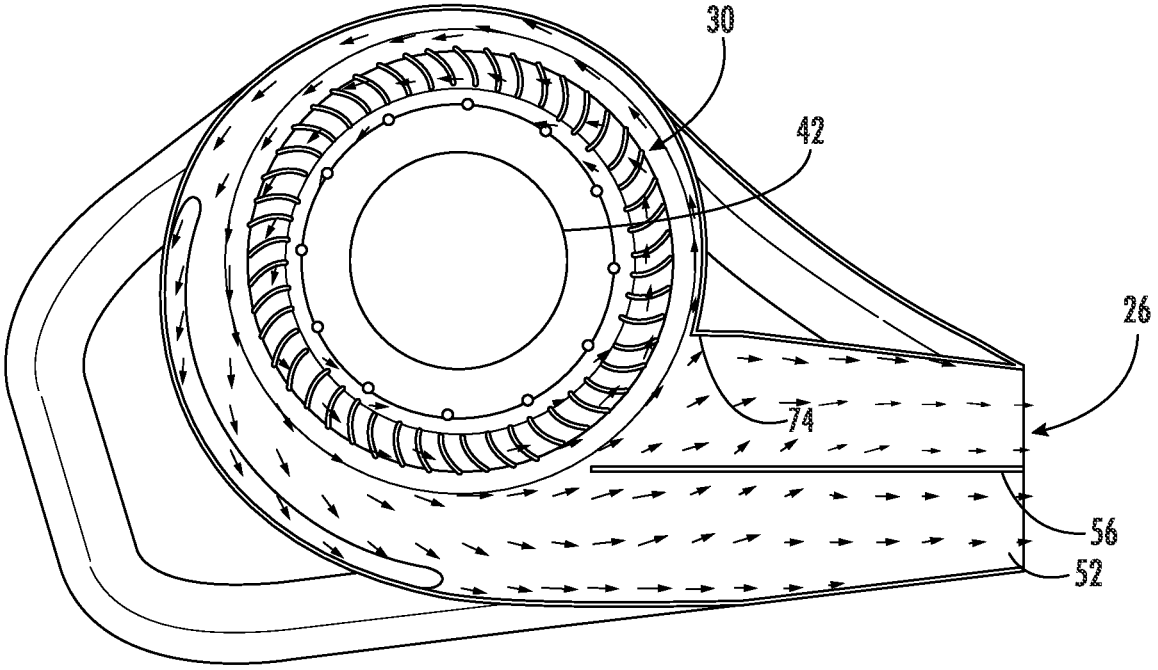

Referring now to FIGS. 12 and 13, airflow in sections 3 and 4 can be visualized. In this regard, FIG. 12 shows vectors that represent air flow in a plane down the center of the fan (i.e., halfway between fins 52 and 54). Not much straightening of the air flow is needed in sections 3 and 4 as long as the chaotic air from the side sections 1, 2, 5, and 6 do not interfere with the straight air in the center. As a result, fin 56 can have a relatively shorter length.

FIG. 13 shows flow vectors in sections 3 and 4 but in an off center plane (e.g., two inches off center). This view of a plane closer to the wall of sections 3 and 4 shows that the air is trying to start the same spiral as in the prior art but is unable to complete a full rotation before encountering the air straightener.

Figure 14:
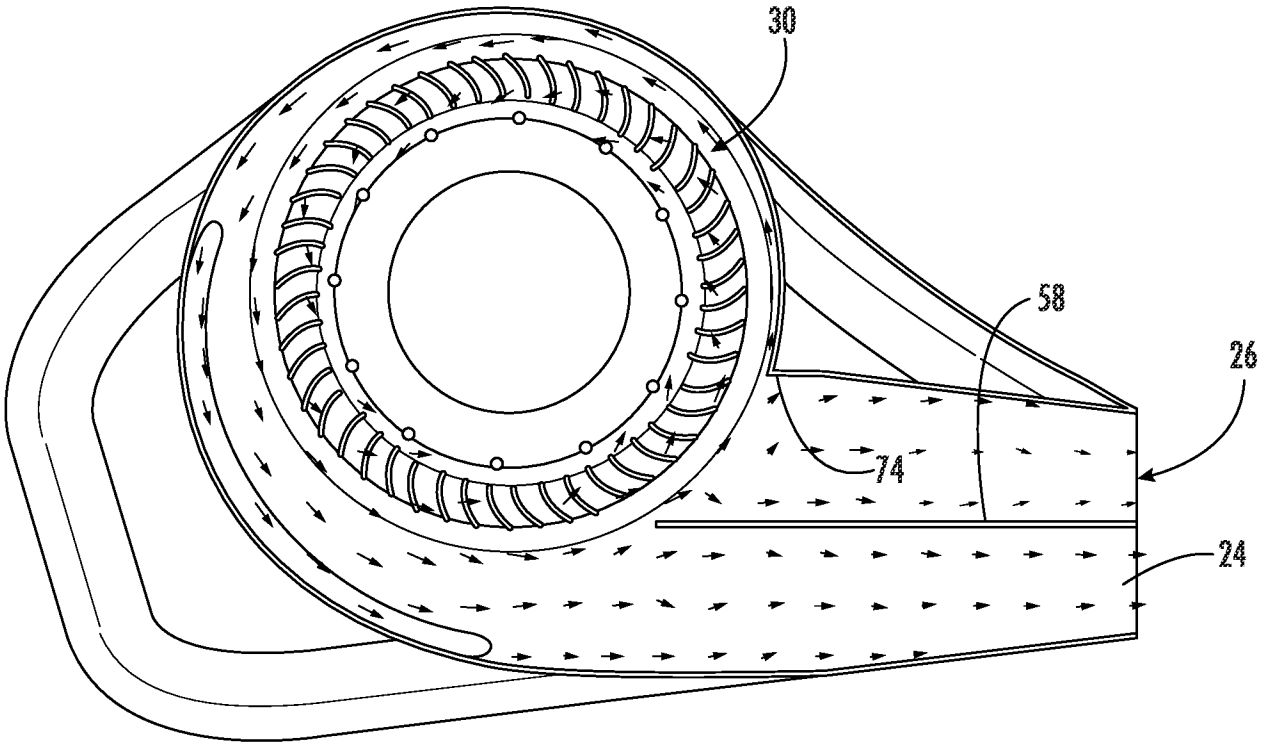
FIG. 14 is a diagrammatic representation showing flow in sections 5 and 6.

FIG. 14 illustrates air flow in sections 5 and 6. As noted above, the fins that define sections 5 and 6, i.e., fins 52 and 58), and similarly the fins that define sections 1 and 2 (i.e., fins 54 and 60), extend to a location just outside the blower outer diameter (at the same radius as the pressure brake 74). In accordance with an aspect of the present invention, it was found that the absence of air straightener fins here would allow air in these side sections to spiral aggressively and have a much lower overall energy than the center sections. By dividing the sections as shown, the straightener acts like an earlier pressure brake to direct the smaller amount of air coming off the side of the blower wheel into a volume that is more appropriate for its flow rate.

As can be seen, almost all the air in sections 5 and 6 is actually directed in section 6 rather than section 5. Because section 5 has very little airflow, it has been found that section 5 can be fully blocked with no detriment to the fan's performance. Airflow in sections 1 and 2 mirror that in sections 5 and 6, meaning that section 1 can be similarly blocked.

Because sections 1 and 5 can be blocked, this allows for mounting of various accessories at this location. This is illustrated in FIG. 15, where sections 1 and 5 are plugged by a respective light device 88 and 90. Devices 88 and 90 include a respective mounting structure 92 and 94 that conforms to the inner periphery of sections 1 and 5. The mounting structure supports one or more light sources (indicated at 96 and 98, respectively) that function as headlights for aiming the fan (thus replacing outboard light 19 discussed above). As one skilled in the art will appreciate, the light sources 96 and 98 may typically comprise a cluster of visible light LEDs. The LEDs may be battery powered or connected to the mains wiring of the fan apparatus 10.

It can thus be seen that the present invention provides an improved fan apparatus which may be used, for example, to exchange air in a semi-trailer. While preferred embodiments of the invention have been shown and described, modifications and variations may be made thereto by those of ordinary skill in the art without departing from the spirit and scope of the present invention. In addition, it should be understood that aspects of the various embodiments may be interchanged both in whole or in part to yield still further embodiments. Furthermore, those of ordinary skill in the art will appreciate that the foregoing description is by way of example only, and is not intended to be limitative of the invention as further described in the appended claims.

What is claimed is:

1. A fan apparatus comprising:

a housing defining at least one air intake and an outlet portion defining an outlet port;

said outlet port having a width and a height, the width being greater than the height;

a blower wheel supported in said housing for rotation about an axis, said blower wheel having a plurality of fan blades spaced apart around a periphery thereof in parallel with said axis; and a flow straightener assembly in the outlet portion of the housing, said flow straightener assembly having:

first and second fins spaced apart from one another and oriented substantially orthogonal to the axis of the blower wheel, the first and second fins extending across the height of the outlet portion from top to bottom;

wherein the first and second fins each have a rearward portion with a curved profile following an outer diameter of the blower wheel; and the flow straightener assembly further comprises third and fourth fins outside of a respective one of the first and second fins, the third and fourth fins being oriented substantially parallel to the axis of the blower wheel, wherein the third and fourth fins extend from the outlet port to the curved profile of the first and second fins, respectively.

2. A fan apparatus as set forth in claim 1, wherein the flow straightener assembly further comprises a fifth fin extending between said first and second fins.

3. A fan apparatus as set forth in claim 2, wherein the fifth fin is oriented substantially parallel to the axis of the blower wheel.

4. A fan apparatus as set forth in claim 3, wherein the fifth fin has a rearward length less than 60% that of the third and fourth fins.

5. A fan apparatus as set forth in claim 3, wherein the fifth fin is substantially aligned with said third and fourth fins across the width of the outlet port.

6. A fan apparatus as set forth in claim 1, wherein upper left and upper right flow sections respectively formed by said first fin and said third fin, and said second fin and said forth fin, are blocked.

7. A fan apparatus as set forth in claim 6, further comprising respective lights at said upper left and upper right flow sections.

8. A fan apparatus as set forth in claim 1, wherein said blower wheel has a cylindrical configuration.

9. A fan apparatus as set forth in claim 1, further comprising:

a mounting bracket attached to said housing; and a pivot arm having a proximal end for pivotal attachment to a fixed structure and a distal end for pivotal attachment to said mounting bracket.

10. A fan apparatus comprising:

a housing defining at least one air intake and an outlet portion defining an outlet port;

said outlet port having a width and a height, the width being greater than the height;

a blower wheel supported in said housing for rotation about an axis, said blower wheel having a plurality of fan blades spaced apart around a periphery thereof in parallel with said axis;

a driver connected to the blower wheel to cause rotation of the blower wheel; and a flow straightener assembly in the outlet portion of the housing, said flow straightener assembly having:

first and second fins spaced apart from one another and oriented substantially orthogonal to the axis of the blower wheel, wherein the first and second fins each have a rearward portion with a curved profile following an outer diameter of the blower wheel; and third and fourth fins outside of a respective one of the first and second fins, the third and fourth fins being oriented substantially parallel to the axis of the blower wheel, wherein the third and fourth fins extend from the outlet port to the curved profile of the first and second fins, respectively.

11. A fan apparatus as set forth in claim 10, wherein the flow straightener assembly further comprises a fifth fin extending between said first and second fins.

12. A fan apparatus as set forth in claim 11, further comprising at least one vertical hand guard mounted to the fifth fin.

13. A fan apparatus as set forth in claim 12, wherein the at least one vertical hand guard comprises first and second vertical hand guards.

14. A fan apparatus as set forth in claim 10, wherein the driver comprises an electric motor.

15. A fan apparatus comprising:

a housing defining at least one air intake and an outlet portion defining an outlet port;

a blower wheel supported in said housing for rotation about an axis;

a driver connected to the blower wheel to cause rotation of the blower wheel; and a flow straightener assembly in the outlet portion of the housing, said flow straightener assembly having:

first and second fins spaced apart from one another and oriented substantially orthogonal to the axis of the blower wheel, wherein the first and second fins each have a rearward portion with a curved profile following an outer diameter of the blower wheel; and third and fourth fins outside of a respective one of the first and second fins, the third and fourth fins being oriented substantially parallel to the axis of the blower wheel, wherein the third and fourth fins extend from the outlet port to the curved profile of the first and second fins, respectively.

16. A fan apparatus as set forth in claim 15, wherein the driver comprises an electric motor.

* * * * *